US005791383A

United States Patent [19]

Eckhardt

[11] Patent Number: 5,791,383

[45] Date of Patent: Aug. 11, 1998

[54] WOVEN FABRIC BELT DEVICE

[75] Inventor: Gerhard Eckhardt, Schottwien, Austria

[73] Assignee: Huyck Austria GmbH, Gloggnitz, Austria

[21] Appl. No.: 703,022

[22] Filed: Aug. 26, 1996

[30] Foreign Application Priority Data

Aug. 28, 1995 [AT] Austria ..... A 1447/95

[51] Int. Cl.[6] ..... D03D 13/00; D03D 15/00

[52] U.S. Cl. ..... 139/383 AA; 428/58

[58] Field of Search ..... 139/383 AA; 428/58

[56] References Cited

U.S. PATENT DOCUMENTS

| | | | |
|---|---|---|---|
| 4,991,630 | 2/1991 | Penven | 139/383 AA |
| 5,188,884 | 2/1993 | Smith | 139/383 AA |
| 5,411,062 | 5/1995 | Lee | 139/383 AA |
| 5,458,161 | 10/1995 | Scarfe | 139/383 AA |
| 5,488,976 | 2/1996 | Lorenz et al. | 139/383 AA |

FOREIGN PATENT DOCUMENTS

| | | |
|---|---|---|
| 2145365 | 2/1973 | France . |
| 281072 | 3/1914 | Germany . |

*Primary Examiner*—Andy Falik

*Attorney, Agent, or Firm*—Michael N. Meller

[57] ABSTRACT

A woven fabric belt device, e.g. an endless screen belt for paper making machines wherein a connection device (7*a*) is provided on at least one end of the woven fabric belt, which connection device is connectable by use of a releasable connecting device (9) to a further connection device (7*b*) which is arranged either at the other end of the same woven fabric belt or at an end of another woven fabric belt. In order to provide protection against wear, a number of predetermined longitudinal threads (2) are removed but not separated from the woven fabric (1,2,6) along a portion thereof (4) associated with the end of the woven fabric belt, wherein the removed portions (4) of the longitudinal threads (2) are rewoven into a horizontal protective layer of the woven fabric. The protective layer is positioned to lie at least one of over, under and both over and under the connection device (7*a*) of the woven fabric belt and thus form a protective layer for this connection device (7*a*).

20 Claims, 2 Drawing Sheets

WOVEN FABRIC BELT DEVICE

BACKGROUND OF THE INVENTION

FIELD OF THE INVENTION

The present invention relates to a woven fabric belt device, e.g. an endless screen belt for paper-making machines, wherein a connection device is provided on at least one end of the woven fabric belt which connection device can be connected by way of a releasable connecting means to a further connection device which is arranged either at the other end of the same woven fabric belt or at the end of another woven fabric belt.

BACKGROUND OF THE PRIOR ART

Releasable connections between the two end-face ends of a woven fabric belt or between the ends of two different woven fabric belts, for example conveyor belts, endless screen belts or the like are known and are described for example in DE-PS 281072, DE-OS 2 059 021, DE-OS 2 338 263, FR-A-2 145 365 and EP-A-564 436. The connection devices for these releasable connections are formed either as individual coupling eyelets, as helical coils or as seam loops. The coupling eyelets or helical coils can be stitched on to the end of the woven fabric or woven into the woven fabric, whereas the seam loops can be produced either by virtue of the woven fabric structure itself or by weaving back into the woven fabric individual longitudinal threads in such a manner as to form a conformal connection. A suitable connecting means is an insertion pin which, once the connection devices are joined together, is inserted through the eyelets, helical coils or seam loops of these connection devices. The insertion pin can be of a straight or helical shape and can comprise a circular or oval cross-section.

In the case of many of the known woven fabric connections the connection devices are however subjected to wear which can impair the serviceable life of the belt, in particular when the woven fabric connection is subject to the heavy mechanical loads of increased pollution. In order to protect a releasable connection of the type mentioned above FR-A-2 145 365 proposes to provide the connection devices with a planar cover which is attached to a woven fabric end. Although such a cover protects the connection, it does have the disadvantage amongst other things that on the one hand it results in additional manufacturing costs and on the other hand the woven fabric belt is thicker at the connection site and therefore not suitable under certain circumstances for all application purposes or is subjected at the minimum to increase wear which in turn reduces the serviceable life of the woven fabric belt.

SUMMARY OF THE INVENTION

It is therefore an object of the invention to improve a woven fabric belt device having a releasable connection of the type mentioned above in such a manner that an effective protection against wear is created for the connection devices. The connection devices can be made at low manufacturing costs, wherein the thickness of the woven fabric belt at this site is not be increased disadvantageously.

This object is achieved according to the invention in the case of a woven fabric belt device of the type mentioned in the introduction by the fact that a number of predetermined longitudinal threads are removed from the woven fabric along one portion allocated to the end of the woven fabric belt and—in a horizontal position of the woven fabric—the removed portions of these longitudinal threads are arranged lying at least in portions over and/or under the connection device of the woven fabric belt and thus form a protective layer for this connection device. Owing to the fact that the protective layer for the connection device is formed by a portion of the woven fabric itself, there are no additional costs during the manufacturing process. When using the woven fabric belt device as a conveyor belt or an endless screen the protective layer formed by certain longitudinal threads can be provided on the product side, on the roller side or on both sides of the connection devices, so that the product side can be protected from premature wear caused by ductors, stripping edges or abrasive materials which are located in the product, e.g. pulp, and the roller side can be protected from wear caused by the roller surface, slippage and possibly stripping or suction edges.

In the case of a preferred embodiment of the woven fabric belt device according to the invention the length of the portions of the removed longitudinal threads is such that the free end of these portions—in the condition where the connection devices are connected to each other—extend either over one or over both connection devices and the connecting means. The effective length of the protection against wear is greatly dependent upon the type of connection and the materials used. In a simple manner the longitudinal threads must be removed in both cases only at one end of the woven fabric belt in order to protect effectively the entire woven fabric connection.

In the case of a preferred embodiment of the device according to the invention, the end of each removed longitudinal thread is aligned against the direction of movement of the woven fabric belt so that the ends are loaded during the operation only by a pulling motion and therefore advantageously need not be attached to the woven fabric.

In the case of an embodiment of the device according to the invention, the number of removed longitudinal threads is allocated only to the lateral edge region of the woven fabric belt. This feature produces an effective protection of the edge region of a connection which is generally especially susceptible to wear, e.g. as format edge protection, which can already lead to a considerable improvement of the serviceable life. As an alterative, the number of removed longitudinal threads can be distributed uniformly over the entire width of the woven fabric belt, producing a uniform effective protection from wear over the entire end of the woven fabric belt.

In the case of a woven fabric produced from synthetic material threads it has proven to be advantageous when the removed portions of longitudinal threads of the woven fabric removed in portions are thermally finished by heating under longitudinal stress since the longitudinal threads are normally curved according to the woven fabric structure.

A particularly advantageous embodiment is produced when the connection device is a row of seam loops at the end of the woven fabric belt or a seam coil of a pin seam attached at this end and when the connecting means is a seam connecting insertion pin of a pin seam which connects two seam loops or seam coils. In the case of this embodiment wherein the row of seam loops or the attachment of the seam coil are formed at the end of the woven fabric belt by predetermined longitudinal threads removed in portions and by adjacent longitudinal threads woven back in portions into the woven fabric to form a conformal connection, wherein longitudinal threads according to the invention are only removed from those sites in the woven fabric where the adjacent longitudinal threads have been woven back into the woven fabric and the portions of removed longitudinal threads form the protective layer. In the case of this embodiment a special connection technique is exploited in order to produce the protective layer. In the event that the connection devices are namely rows of seam loops or seam coils attached by seam loops to the woven fabric, then the seam loops are produced in the conventional manner so that predetermined longitudinal threads are removed along a portion of the woven fabric in order to be able to weave back adjacent longitudinal threads into the woven fabric to form a conformal connection whilst forming in each case a seam loop, wherein the removed longitudinal threads are normally cut off at the site where they exit the woven fabric. In contrast thereto, in the case of the woven fabric belt device according to the invention the removed longitudinal threads are not cut off but rather are used to form a protective layer for the connection devices, the said protective layer even being formed in this case whilst saving costs since one operational procedure, namely the cutting off of the removed longitudinal threads, can be omitted.

DRAWINGS

In FIG. 2 the removed portions of the fabric is both below and above the fabric.

Figure 1:
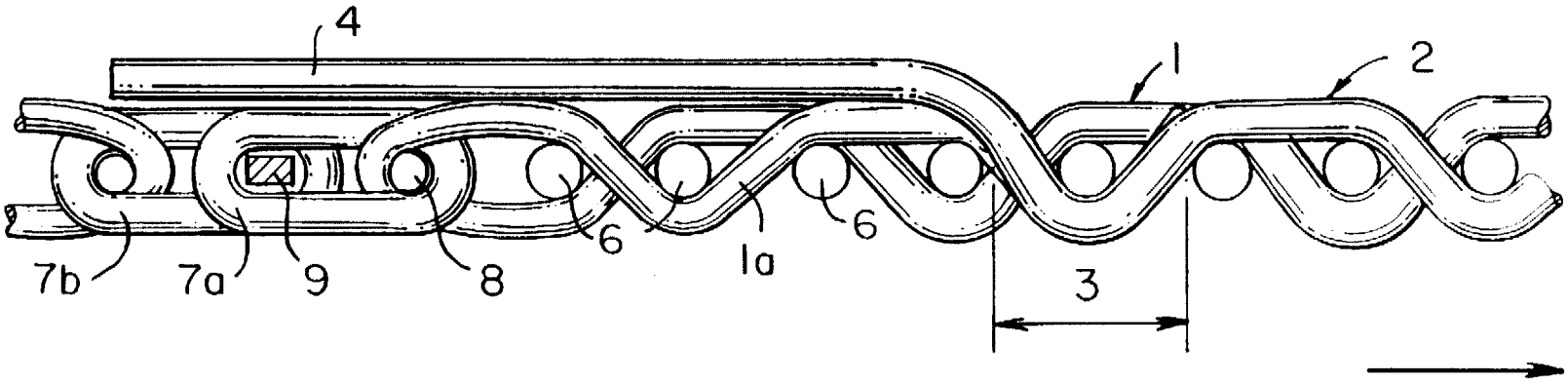
FIG. 1 shows a structure of the fabric in accordance with the present invention in which a portion of the fabric (4) is extended above the fabric.
Figure 2:
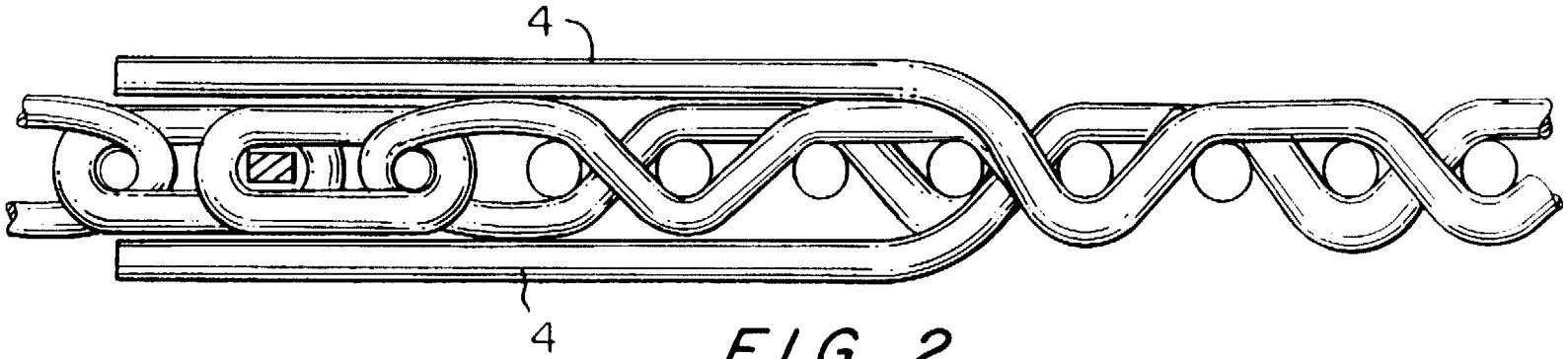
FIG. 2 shows a removed portion of the fabric (labeled 4).
Figure 3:
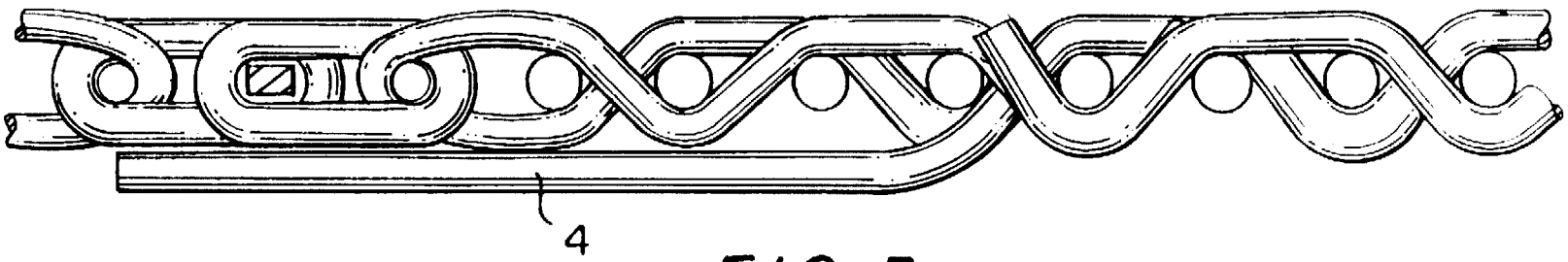
FIG. 3 shows that the portion 4 is below the fabric.

all other reference numbers of FIGS. 2 and 3 correspond to the elements shown in FIG. 1 and their respective functions are the same as the elements shown in FIG. 1.

DETAILED DESCRIPTION

Further advantages and features of a woven fabric belt device of the type embodying the invention are evident from the following description of a specific exemplified embodiment, wherein reference is made to the attached figure in which is illustrated a schematic lateral view of a woven fabric belt device in the region of the releasable connection using as an example an endless screen for paper making machines.

It is evident from the figure 1 that the woven fabric of the endless screen is produced from longitudinal threads 1, 2 and from transverse threads 6. At the end of the woven fabric seam loops are provided for the purpose of attaching a seam coil 7*a* which seam loops are produced by weaving back into the woven fabric to form a conformal connection one portion 1*a* of the longitudinal threads 1. In order to render possible or facilitate the weaving back of these threads an adjacent longitudinal thread 2 is removed from the woven fabric along a portion 4. At the other end of the woven fabric belt a further seam coil 7*b* is attached in a similar or identical manner. The coils 7*a* and 7*b* formed with an oval cross-section in the case of the present exemplified embodiment can be pushed into each other laterally and are held against each other by a straight, flat insertion pin 9 which can be inserted in parallel with the woven fabric end. The end of the woven-back portion 1*a* of the longitudinal thread I protrudes in the case of the illustrated exemplified embodiment by one transverse thread 6 further into the woven fabric than the portion 4 of the longitudinal thread 2 removed from the woven fabric, so that at the region 3 an overlap is formed which causes a better hold of the woven-back portion 1*a* in the woven fabric structure. In the case of the illustrated exemplified embodiment an additional respective holding wire 8 which extends substantially in parallel with the flat insertion pin 9 is provided in the connection region between the seam loops and the seam coils 7*a*, 7*b*.

The portion 4 of the longitudinal thread is now not cut off at the site where it exits the woven fabric but rather is placed over the seam coils 7*a*, 7*b* in order to provide there a seam protection, wherein the end of the portion 4 is aligned against the running direction of the endless screen characterised by an arrow, so that no further attachment of the portion 4 is necessary.

As an alternative to the illustrated exemplified embodiment, the portions of longitudinal threads serving to protect the seam are also arranged below the woven fabric or on both sides of the woven fabric. Likewise it is possible that the removed longitudinal threads are not distributed uniformly over the width of the woven fabric belt but rather are only allocated to the lateral edge of the woven fabric belt in order to form a protection against wear for this lateral end region. In the event that the woven fabric belt is to be loaded differently, e.g. by virtue of a particular shape of roller, then the protection against wear can also be provided only on the sites of the woven fabric connection which are to be heavily loaded.

At the other end of the endless screen allocated to the seam coil 7*b* the portions of longitudinal threads removed from the woven fabric in the conventional manner are cut off at the site where they exit the woven fabric so that these longitudinal threads, aligned in the running direction of the screen, are not used to form the seam protection in the illustrated exemplified embodiment.

Both the woven fabric 1, 2, 6 and also the seam coils 7*a*, 7*b* and the insertion pin 9 are produced in the illustrated exemplified embodiment from a synthetic material. Since the portions 4 of the longitudinal threads 2 after they have been removed have so-called crimps, i.e. are curved in a snake-like manner according to the woven fabric structure, these are pulled flat by thermo-fixing the seam loop by means of a heating process under longitudinal stress.

The length of the portions 4 of the longitudinal threads 2 can vary depending upon the individual application, for example the end of the portion 4, as illustrated in the figure, can protrude beyond both rows of seam loops or this end can protrude only over one connection device 7*a* or rather the insertion pin 9 and also reach only as far as the seam loop row at the end of the woven fabric belt.

Naturally the present invention is not limited to the illustrated exemplified embodiment but rather includes all embodiments of a woven fabric belt device which comprise a protective layer formed by removed longitudinal threads for a releasable connection.

I claim:

1. Woven fabric belt device, such as an endless screen belt for paper making machines wherein a connection device is provided at least on one end of the woven fabric belt, which connection device is connected via a releasable connecting means to a further connection device which is arranged to be on one of another end of the same woven fabric belt and at an end of another woven fabric belt, wherein:

a number of predetermined longitudinal threads of the woven fabric belt are separated but not severed from the woven fabric along a portion thereof, associated with the at least one end of the woven fabric belt; and a horizontal protective layer of the woven fabric being formed from the removed portions of the longitudinal threads that are arranged so that at least portions of the protective layer are one of over, under and both over and under the connection device and the rewoven protective layer has a same thickness as other portions of the woven fabric belt.

2. Woven fabric belt device according to claim 1, wherein a length of portions of the removed longitudinal threads are dimensioned such that a free end of the portions of the removed longitudinal threads extend at least over one of the connection devices and the connecting means, when the connection devices are connected to each other.

3. Woven fabric belt device according to claim 2, wherein the removed longitudinal threads are distributed along a lateral edge region of the woven fabric belt.

4. Woven fabric belt device according to claim 2, wherein the removed longitudinal threads are distributed along a lateral edge region of the woven fabric belt.

5. Woven fabric belt device according to claim 2, wherein the woven fabric belt is produced from synthetic material threads and the removed portions of the longitudinal threads of the woven fabric belt are thermally finished by means of a heating process which is under longitudinal stress to remove a curvature of the synthetic material.

6. Woven fabric belt device according to claim 1, wherein a number of removed longitudinal threads are distributed along a lateral edge region of the woven fabric belt.

7. Woven fabric belt device according to claim 6, wherein the woven fabric is produced from synthetic material threads and the removed portions of the longitudinal threads of the woven fabric are thermally finished by means of a heating process under longitudinal stress to remove a curvature of the synthetic material.

8. Woven fabric belt device according to claim 6, wherein the connection device comprises one of a row of seam loops extending at an end of the woven fabric belt and a seam coil of a pin seam attached at this end.

9. Woven fabric belt device according to claim 6, wherein the number of removed longitudinal threads are distributed uniformly over an entire width of the woven fabric belt.

10. Woven fabric belt device according to claim 9, wherein the woven fabric is produced from synthetic material threads such that the removed portions of the longitudinal threads of the woven fabric are thermally finished by means of a heating process under longitudinal stress to remove a curvature of the synthetic material.

11. Woven fabric belt device according to claim 9, wherein the connection device comprises one of a row of seam loops extending at an end of the woven fabric belt and a seam coil of a pin seam attached at this end.

12. Woven fabric belt device according to claim 1, wherein the woven fabric belt is produced from synthetic material threads and the removed portions of the longitudinal threads of the woven fabric belt are thermally finished by means of a heating process under longitudinal stress to eliminate a curvature of said woven fabric belt.

13. Woven fabric belt device according to claim 12, wherein the connection device comprises one of a row of seam loops extending at one end of the woven fabric belt and a seam coil of a pin seam attached at the one end.

14. Woven fabric belt device according to claim 12, wherein the connection device comprises a row of seam loops extending at an end of the woven fabric belt and a seam coil of a pin seam attached at this end.

15. Woven fabric belt device according to claim 2, wherein the connection device comprises one of a row of seam loops extending at one end of the woven fabric belt, and a seam coil of a pin seam attached at the one end.

16. Woven fabric belt device according to claim 1, wherein the connecting means comprises a seam connecting insertion pin of a pin seam for connecting one of two seam loops and seam coils.

17. Woven fabric belt device according to claim 1, wherein the connection device comprises one of a row of seam loops extending from the end of the woven fabric belt at which the connection device is provided and a seam coil of a pin seam attached at said end of said woven fabric belt.

18. Woven fabric belt device according to claim 17, wherein one of the row of seam loops and an attachment of the seam coils is provided at the at least one end of the woven fabric belt, the removed longitudinal threads being woven together with a plurality of adjacent longitudinal threads remaining in the woven fabric belt in those portions of the woven fabric belt to form a conformal connection, such that the removed longitudinal threads are removed from the woven fabric belt at those positions of the woven fabric belt where the adjacent longitudinal threads of the woven belt are to be woven back into the woven fabric belt along with the removed portions of the longitudinal threads to form the protective layer.

19. Woven fabric belt device according to claim 17, wherein the row of seam loops or an attachment of the seam coil is formed at the end of the woven fabric belt by predetermined longitudinal threads in and by adjacent longitudinal threads of the woven fabric belt that are to be woven back into the woven fabric belt to form a conformal connection, and wherein the longitudinal threads are only removed from the woven fabric belt at those sites where the adjacent longitudinal threads are to be woven back into the woven fabric belt and the portions of the removed threads form the protective layer.

20. A method for providing a protective layer for a connection device of a woven fabric belt device such as an endless screen belt for paper making machines wherein the connection device is provided at at least a first end of the woven fabric belt and the connection device is connected via a releasable connecting means to a further connecting device which is arranged at one of the at least the first and a second end of a same woven fabric belt and at an end of another woven fabric belt, the steps comprising:

removing a number of longitudinal threads from the woven fabric belt along a portion hereof associated with at least one of a first and a second end of the woven fabric belt;

forming a protective horizontal layer from the removed portions of the longitudinal threads so that the removed portions of the longitudinal threads provide the protective layer at least in those portions of the woven fabric belt that are at least one of over, under and both over and under the connection device of the woven fabric belt whereby the protective layer protects the connection device and has a same thickness as other portions of the woven fabric.

* * * * *